United States Patent [19]

Carruth et al.

[11] 4,265,151

[45] May 5, 1981

[54] APPARATUS FOR REMOVING LONG STRANDS FROM CHOPPED STRAND MATERIAL

[75] Inventors: Grant F. Carruth, Granville; Fred S. Coffey, Newark, both of Ohio; Ray M. Fulmer, Aiken, S.C.

[73] Assignee: Owens-Corning Fiberglas Corporation, Toledo, Ohio

[21] Appl. No.: 62,379

[22] Filed: Jul. 31, 1979

[51] Int. Cl.[3] ..... D01G 1/04

[52] U.S. Cl. ..... 83/102; 83/913; 241/187; 209/616

[58] Field of Search ..... 83/161, 102, 107, 913; 241/187, 189, 79, 80; 209/616, 672, 664, 667

[56] References Cited

U.S. PATENT DOCUMENTS

| | | | |
|---|---|---|---|
| 781,616 | 1/1905 | Owens et al. | 209/616 X |
| 2,374,456 | 4/1945 | Ravndal et al. | 241/187 X |
| 2,540,021 | 1/1951 | Wright | 241/187 |
| 2,555,879 | 6/1951 | Fogle | 241/187 X |
| 3,145,937 | 8/1964 | Scovel et al. | 241/187 X |
| 3,362,270 | 1/1968 | Meath et al. | 83/913 X |

*Primary Examiner*—Frank T. Yost

*Attorney, Agent, or Firm*—Ronald C. Hudgens; Philip R. Cloutier; Paul J. Rose

[57] ABSTRACT

Two horizontally spaced parallel shafts (27,28) are rotatably mounted on a base plate (24) having an aperture (**27*a*) therethrough. Each shaft has a plurality of rows of radially extending fingers (36). A casing (38,40) around the fingered portions of the shafts has an inlet throat (44) for receiving shopped strands (16). The shafts are operatively connected by a pair of gears (32,34), and a motor (30**) connected to one of the shafts drives the shafts to move the fingers upwardly between the shafts for breaking up clumps of strands and carrying strands of a desired chopped length around the outer sides of the shafts for exit through the aperture. Excessively long strands become wrapped around one or the other of the shafts.

2 Claims, 3 Drawing Figures

APPARATUS FOR REMOVING LONG STRANDS FROM CHOPPED STRAND MATERIAL

TECHNICAL FIELD

This invention relates generally to apparatus for chopping continuous fibrous glass strands into chopped strands of desired relatively short length, and more particularly to apparatus for removing chopped strands longer than the desired length from a stream of chopped strands while permitting passage of chopped strands of the desired length.

BACKGROUND ART

Relatively short chopped fibrous glass strands are frequently shipped in cartons for further processing in the manufacture of other products. Equipment designed to handle relatively short chopped strands can be deleteriously affected when called upon to handle relatively long strands inadvertently included in the cartons. Occurrence of relatively long strands in the intended production of relatively short chopped glass strands indicates that the chopper needs adjustment. Formerly, visual inspection of the chopped strands in a carton was relied upon to detect the presence of chopped strands that were too long. Sometimes the long chopped strands were not detected immediately, and occasionally cartons containing some long strands were made ready for shipment before discovery of long strands in the carton then being filled.

DISCLOSURE OF INVENTION

In accordance with the invention, apparatus for removing long strands is interposed between a chute delivering chopped strands and the collecting carton. Long strands are collected on the apparatus and are highly visible, readily indicating the need for adjustment of the chopper and preventing inadvertent inclusion of too long strands in the carton. The apparatus includes a pair of oppositely rotatable shafts provided with radially extending fingers.

BRIEF DESCRIPTION OF DRAWINGS

In the accompanying drawing.

BEST MODE OF CARRYING OUT THE INVENTION

Figure 1:
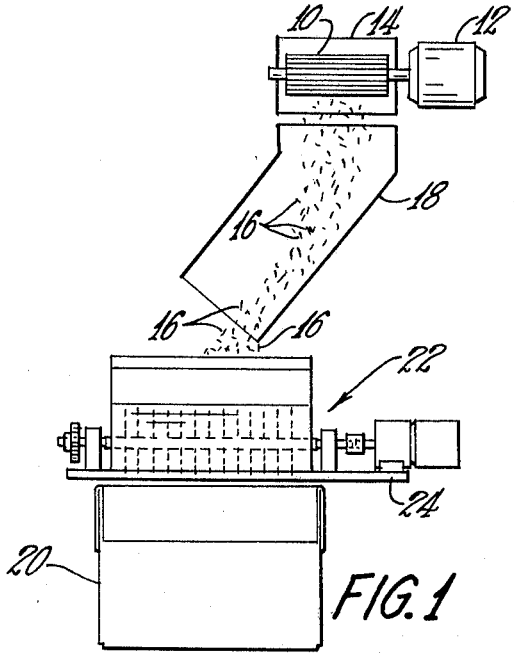
FIG. 1 is a schematic elevational view of glass strand chopping and collecting means including the long strand removal apparatus of the invention.
Figure 2:
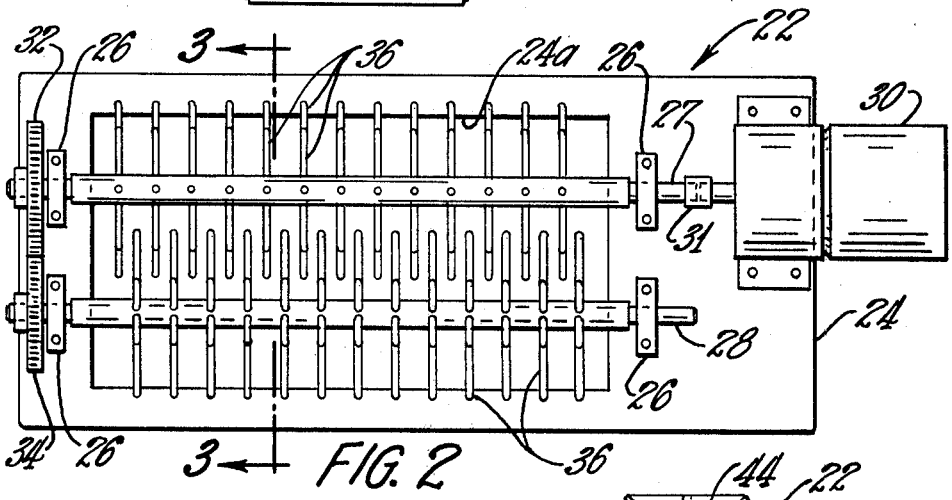
FIG. 2 is a plan view of the long strand removal apparatus of FIG. 1, with a cover omitted.

With respect to the drawings, FIG. 1 shows conventional glass strand chopping apparatus including a chopping roll 10 having the usual chopping blades, a motor 12 for driving the chopping roll 10, and a back-up roll 14 for the chopping roll 10. Glass strand fed between the rolls 10 and 14 is chopped into chopped strands 16 of relatively short length. The chopped strands 16 fall through a chute 18 and into a carton 20. A portion of the chute 18 is omitted in FIG. 1 to show the chopped strands 16.

In accordance with the invention, long strand removing apparatus 22 is disposed between the outlet of the chute 18 and the carton 20. The apparatus 22 includes a base plate 24 longer than a corresponding dimension of the carton 20 and having a large rectangular aperture **24*a* for the passage of chopped fibrous glass strands 16 therethrough into the carton 20. Four bearing blocks 26 mounted on the base plate 24 rotatably support a pair of parallel shafts 27 and 28 adjacent opposite ends thereof. A motor 30 mounted on the base plate 24 drives the shaft 27 at one end through a coupling 31. A gear 32 mounted on the shaft 27 adjacent the other end from the coupling 31 meshes with a gear 34 mounted on the shaft 28. In the embodiment shown, the gear 34 is smaller than the gear 32, and therefore the shaft 28 rotates faster than the shaft 27**.

Each of the shafts 27 and 28 is provided with a plurality of radially extending fingers 36. In the embodiment shown, each shaft has eight axially extending rows of fingers 36, there being thirteen equally spaced fingers 36 in each row and the rows being arcuately spaced forty-five degrees from each other. The fingers 36 on one shaft are staggered from those on the other shaft axially of the shafts. Holes are drilled in the shafts for the reception of the radially inner end portions of the fingers.

A casing is provided by two half-covers 38 and 40 pivotally connected to the base plate 24 respectively by hinges 39 and 41 disposed respectively on opposite sides of the aperture **24*a*. Each half-cover has a pair of opposite end plate portions, one end plate portion 38*a* and one end plate portion 40*a* being shown in FIG. 3. Two stationary end plates 42, only one of which is shown in FIG. 3, are secured to the base plate 24 beneath the shafts 27 and 28 respectively adjacent opposite ends of the aperature 24*a***.

Figure 3:
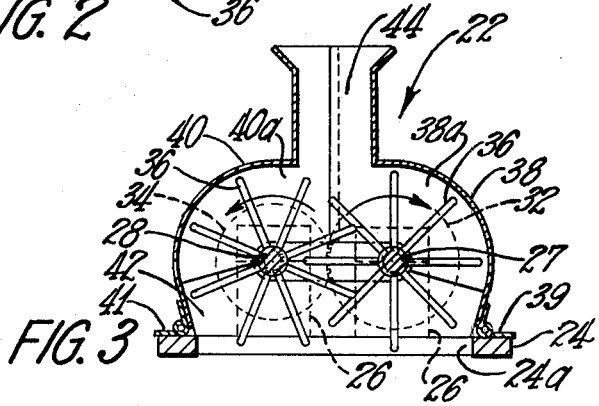
FIG. 3 is a sectional view taken generally along the line 3—3 of FIG. 2, but including the cover.

When the half-covers 38 and 40 are folded together as shown in FIG. 3, they form an inlet throat 44 for the chopped strands 16. The half-covers 38 and 40 may be made of clear plastic or provided with appropriate windows for ready inspection of the portions of the shafts 27 and 28 therewithin, and are pivoted apart when removal of long fibers from the shafts 27 and 28 is necessary.

The shafts 27 and 28 are rotated in the directions shown in FIG. 3, whereby the fingers 36 rotate upwardly between the shafts, fluff up clumps of the chopped strands 16, and move the chopped strands downwardly on the outer sides of the shafts for discharge through the aperture **24*a* into a carton 20. In the actual embodiment, the main part of each of the shafts 27 and 28 has a diameter of three-fourths of an inch (1.91 cm.) and the fingers 36 of each row are centered one inch (2.54 cm.) apart. Each finger 36 has a diameter of one-eight of an inch (0.32 cm.) and projects two inches (5.08 cm.) from its shaft 27 and 28. The desired length of the chopped strands 16 may be one-eighth of an inch (0.32 cm.), two inches (5.08 cm.), or any length between one-eighth and two inches, but in all cases, chopped strands having a length of about four inches (10.16 cm.) or longer will be wrapped around one of the shafts 27 and 28 rather than deposited in a carton 20**.

We claim:

1. In glass strand chopping and collecting apparatus including a chopping apparatus (10,12,14), a collecting carton (20), and a chute (18) for receiving chopped glass strands (16) from the chopping apparatus and directing them into the carton, the improvement comprising apparatus (22) for removing strands longer than a desired chopped length, the long strand removing apparatus being disposed between the carton and the chute and comprising a base plate (24) having an aperture (**24*a***)

therethrough, a casing formed principally of two half-covers (38,40) pivotally mounted on the base plate respectively on opposite sides of the aperture and collectively providing an inlet throat (44) for receiving chopped glass strands from the chute for delivery through the aperture in the base plate into the carton, a pair of spaced parallel shafts (27,28) rotatably mounted on the base plate and extending through the casing over the aperture, each shaft having a plurality of rows of radially extending fingers (36) mounted thereon, the rows on each shaft extending axially thereof and being equally arcuately spaced from each other, the fingers of each row being equally spaced from each other, and the fingers on one shaft being staggered from those on the other shaft axially of the shafts, and means (30,31,32,34) for rotatably driving the shafts in opposite directions whereby the fingers move upwardly in interleaving relationship between the shafts, strands longer than the desired chopped length are wrapped around one or the other of the shafts, and strands of the desired chopped length pass through the aperture generally on the outer sides of said shafts as distinct from between the shafts.

2. Apparatus (22) for removing strands longer than a desired chopped length from a stream of chopped strands while permitting passage of chopped strands (16) of the desired length, the apparatus comprising a base plate (24) having an aperture (24*a*) therethrough, a casing formed principally of two half-covers (38,40) pivotally mounted on the base plate respectively on opposite sides of the aperture and collectively providing an upwardly opening inlet throat (44) for receiving chopped strands, a pair of rotatably mounted horizontally spaced parallel shafts (27,28) disposed between the inlet throat and the aperture, each shaft having a plurality of rows of radially extending fingers (36) mounted thereon, the rows on each shaft extending axially thereof and being equally arcuately spaced from each other, the fingers of each row being equally spaced from each other, and the fingers on one shaft being staggered from those on the other shaft axially of the shafts, and means (30,31,32,34) for rotatably driving the shafts in opposite directions to move the fingers upwardly in interleaving relationship between the shafts.

* * * * *